US005140759A

United States Patent [19]

Artzberger

[11] Patent Number: 5,140,759

[45] Date of Patent: Aug. 25, 1992

[54] PNEUMATIC DEVICE FOR EXCAVATING AND REMOVING MATERIAL

[75] Inventor: Thomas G. Artzberger, Hartford, Wis.

[73] Assignee: M-B-W Inc., Slinger, Wis.

[21] Appl. No.: 715,540

[22] Filed: Jun. 14, 1991

[51] Int. Cl.[5] ..... E02F 5/02; F16K 1/00

[52] U.S. Cl. ..... 37/80 R; 137/874; 137/876; 406/112; 37/62; 37/63

[58] Field of Search ..... 37/80 R, 61, 62, 63, 37/75, 76, 78; 175/317, 324, 424, 393; 137/625.46, 874, 876; 406/183, 129, 112

[56] References Cited

U.S. PATENT DOCUMENTS

| | | | |
|---|---|---|---|
| 1,778,942 | 10/1930 | Harp | 37/63 |
| 2,599,980 | 6/1952 | Dunning | 37/62 |
| 2,711,598 | 6/1955 | Craggs, Jr. | 37/62 |
| 4,479,741 | 10/1984 | Berti et al. | 37/63 |
| 4,705,627 | 11/1987 | Miwa et al. | 137/625.46 |
| 4,776,731 | 10/1988 | Briggs et al. | 406/153 |
| 4,936,031 | 6/1990 | Briggs et al. | 37/80 R |
| 4,946,434 | 8/1990 | Plaisted et al. | 137/625.46 |
| 4,991,321 | 2/1991 | Artzberger | 37/62 |
| 4,995,175 | 3/1991 | Winter | 37/63 |

FOREIGN PATENT DOCUMENTS

| | | | |
|---|---|---|---|
| 265537 | 5/1988 | European Pat. Off. | 137/625.46 |
| 0251660 | 10/1987 | Fed. Rep. of Germany . | |

*Primary Examiner*—Randolph A. Reese
*Assistant Examiner*—Spencer Warmick
*Attorney, Agent, or Firm*—Andrus, Sceales, Starke & Sawall

[57] ABSTRACT

A high velocity pneumatic device for excavating and removing material such as soil. The device includes a pressure tube having an inlet connected to a source of gas, such as air, under pressure and an outlet end connected to the distal end of a removal conduit. An annular member is secured in the distal end of the removal conduit and defines an annular chamber that communicates with the outlet end of the pressure tube. A plurality of first nozzles communicate with the chamber and face outwardly of the distal end of the removal conduit, while a plurality of second nozzles communicate with the chamber and face inwardly of the conduit. A manually operated valve member is disposed in the chamber and rotation of the valve member will selectively discharge air through the first nozzles to provide an excavating action, or through the second nozzles to provide an aspirating action for the removal of material or through both the first and second nozzles to create both an excavating and removal mode of operation.

17 Claims, 2 Drawing Sheets

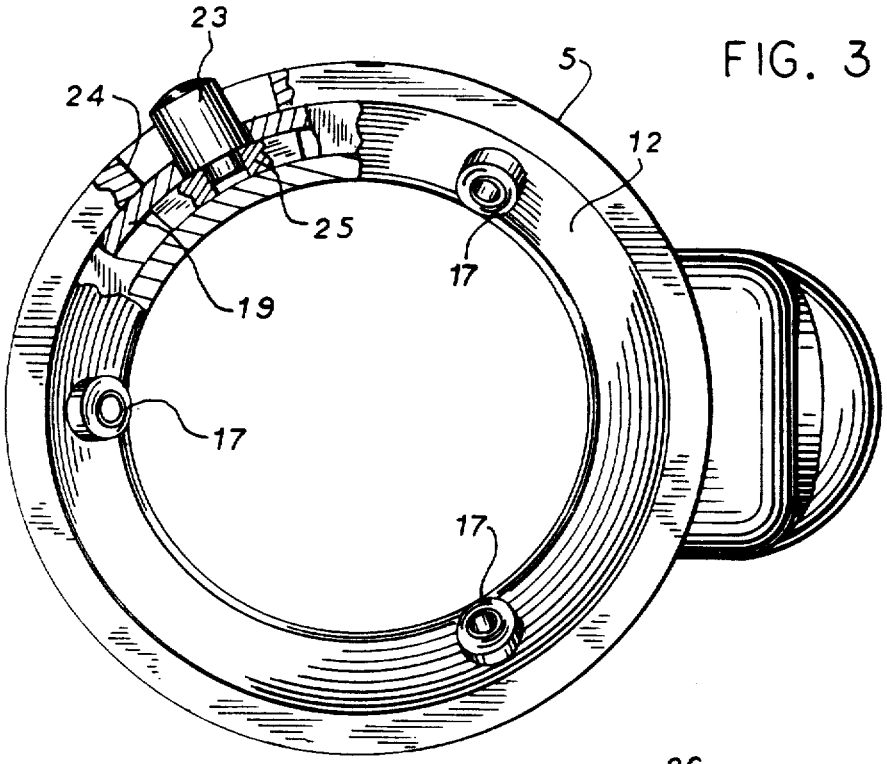
FIG. 3
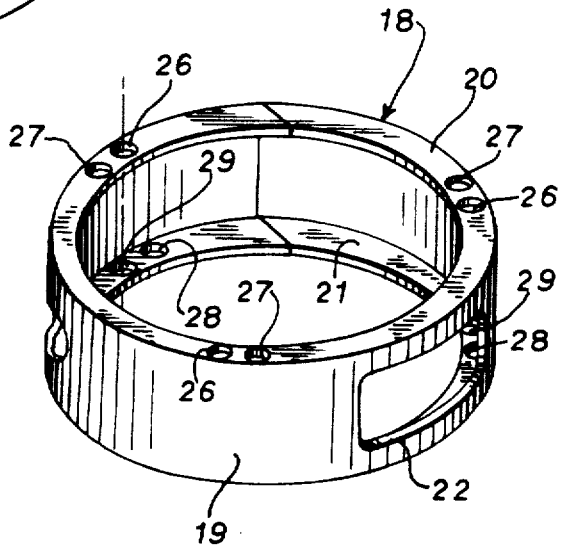
FIG. 4
FIG. 5
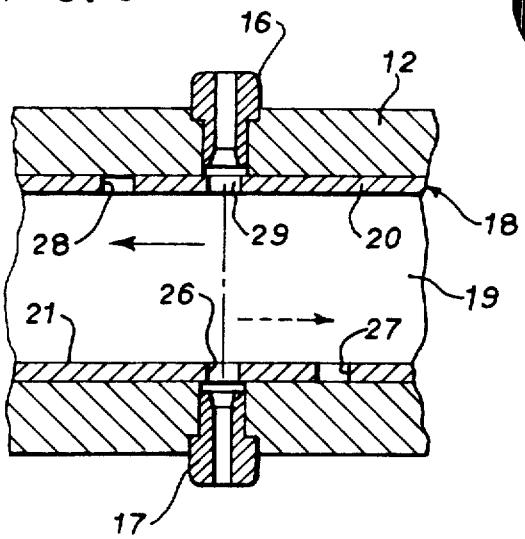

PNEUMATIC DEVICE FOR EXCAVATING AND REMOVING MATERIAL

BACKGROUND OF THE INVENTION

High velocity pneumatic devices are used in construction work to excavate or dislodge soil from around electrical cables, gas mains, water pipes and the like. The pneumatic device has the advantage of being capable of pulverizing the soil without damaging the utility lines.

The typical high velocity pneumatic device consists of a body or housing which carries an elongated tube. The body is connected to a source of air under pressure, such as a compressor, and a valve mechanism mounted in the body controls the flow of air to the tube. Mounted on the distal end of the tube is a nozzle which is designed to increase the velocity of the air being discharged from the tube toward the soil. The typical nozzle is provided with an inwardly converging upstream end which merges into a diverging downstream end and this configuration acts to reduce the pressure of the air and increase its velocity.

High velocity pneumatic devices have also been employed to both dislodge soil or other material and to remove the dislodged soil. U.S. Pat. No. 4,991,321 describes such a device that can be used for both excavating and removing material. The device includes a body or housing which carries an elongated pressure tube and the body is connected to a source of air under pressure. A valve mechanism, located in the body, controls the flow of air to the pressure tube.

The outer or distal end of the pressure tube of the device described in the aforementioned patent is bent and projects laterally into a larger diameter removal tube. The projecting end of the pressure tube is provided with a pair of outlets, one of which faces outwardly away from the distal end of the removal tube while the other outlet faces inwardly of the removal tube. A nozzle is removably connected to the first outlet and is designed to increase the velocity of the air flowing through the nozzle toward the soil. The high velocity air being discharged from the nozzle will serve to dislodge or pulverize the soil.

The second outlet in the pressure tube of the device of the aforementioned patent contains a plurality of orifice openings and a portion of the air in the pressure tube can be directed through the second outlet to create an aspirating action to draw the pulverized or dislodged soil upwardly into the removal tube. A flexible conduit is connected to the end of the removal tube to direct the removed soil to a discharge site. Thus the device can be employed to not only dislodge the soil but to remove the soil from the excavation site.

Instead of using the device as described in U.S. Pat. No. 4,991,321 for both excavation and removal, the device can be used only for excavating or only for removal of material but in these modes of operation, it is necessary to attach a plug or closure to the outlet of the pressure tube which is not to be utilized. For example, if the device is only to be used for excavating, a solid plug must be attached to the second outlet so that the entire stream of air is directed through the first outlet toward the soil. Conversely, if it is desired only to remove material, a solid plug must be attached to the first outlet in place of the nozzle so that the entire flow of air is then directed through the second outlet to create an aspirating action. Thus, with the device of the aforementioned patent, it is necessary to remove and attach components to provide the various functions.

As the outlets of the device of the aforementioned patent are located centrally of the removal tube, the cross-sectional area of the removal tube is somewhat obstructed and if a large object, such as a stone, is drawn up into the removal tube and lodges against the projecting end of the pressure tube, the stone must be removed by shutting off the flow of air which will release the aspirating action.

SUMMARY OF THE INVENTION

The invention is directed to an improved high velocity pneumatic device for excavating and removing material such as soil. The device has the ability to change between an excavating function, a removal function or a combination of both without the necessity of the removal or attachment of auxiliary components.

The device of the invention includes a body or housing which carries an elongated pressure tube. The body is connected to a source of gas, such as air, under pressure and a valve mechanism located in the body, controls the flow of air to the pressure tube. The outer or distal end of the pressure tube is connected to the distal end of a removal conduit. Secured within the distal end of the removal conduit is an annular member which defines an annular chamber that communicates with the outlet end of the pressure tube.

A plurality of downwardly facing nozzles communicate with the chamber and face outwardly of the removal conduit, while a plurality of upwardly facing nozzles also communicate with the chamber and face inwardly of the removal conduit.

A manually operated valve member is disposed in the chamber and through manual rotation of the valve member, the air in the chamber can be selectively discharged through the first nozzles toward the soil to provide an excavating function, or upwardly through the second nozzles to provide an aspirating action in the removal tube to remove dislodged material, or through both the first and second nozzles to provide both an excavating and removal mode.

The manually operated valve member enables the device to readily change from one function to another or to a combination of functions. Furthermore, rotation of the valve member enables the excavating and removal functions to be throttled so that any desired degree of excavation and removal can be obtained.

The annular member which is secured within the distal end of the removal tube and contains the nozzles has a relatively large central opening which minimizes clogging of the removal conduit.

Other objects and advantages will appear in the course of the following description.

DESCRIPTION OF THE DRAWINGS

The drawings illustrate the best mode presently contemplated for carrying out the invention.

In the drawings:

FIG. 3 is a bottom view of the device with parts broken away in section;

FIG. 4 is a prospective view of the valve member; and

FIG. 5 is a diagrammatic view showing the operating of the valve member.

DESCRIPTION OF THE ILLUSTRATED EMBODIMENT

Figure 1:
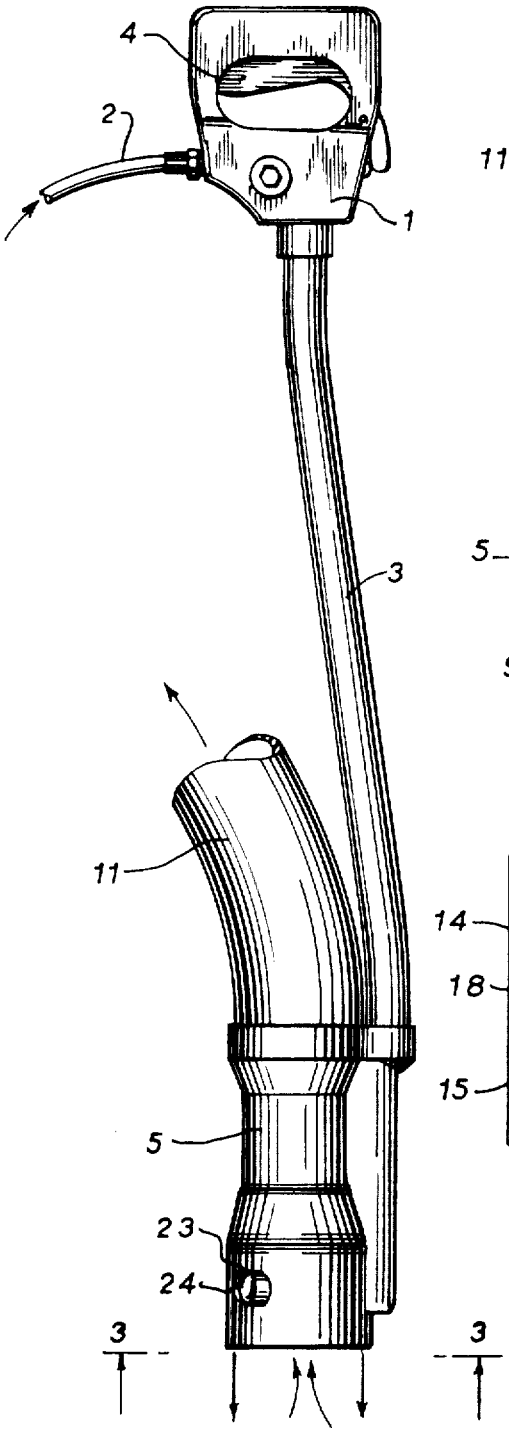
FIG. 1 is a side elevation of the pneumatic device of the invention.

The drawings illustrate a high velocity pneumatic device having particular use in excavating or dislodging soil around utility lines, trees, shrubs or the like. The device includes a body or housing 1 which is connected through an air supply line 2 to a source of gas, such as air, under pressure. An elongated tube 3, preferably formed of electrically non-conductive or dielectric material, such as fiber reinforced resin, is connected to the body 1, and a valve control mechanism, not shown, located within body 1 and actuated by a trigger 4 controls the flow of air through the body to the tube. The trigger and valve control mechanism can be constructed as disclosed in U.S. patent application Ser. No. 07/541,377, filed Jun. 21, 1990, and the construction of that application is incorporated herein by reference.

Figure 2:
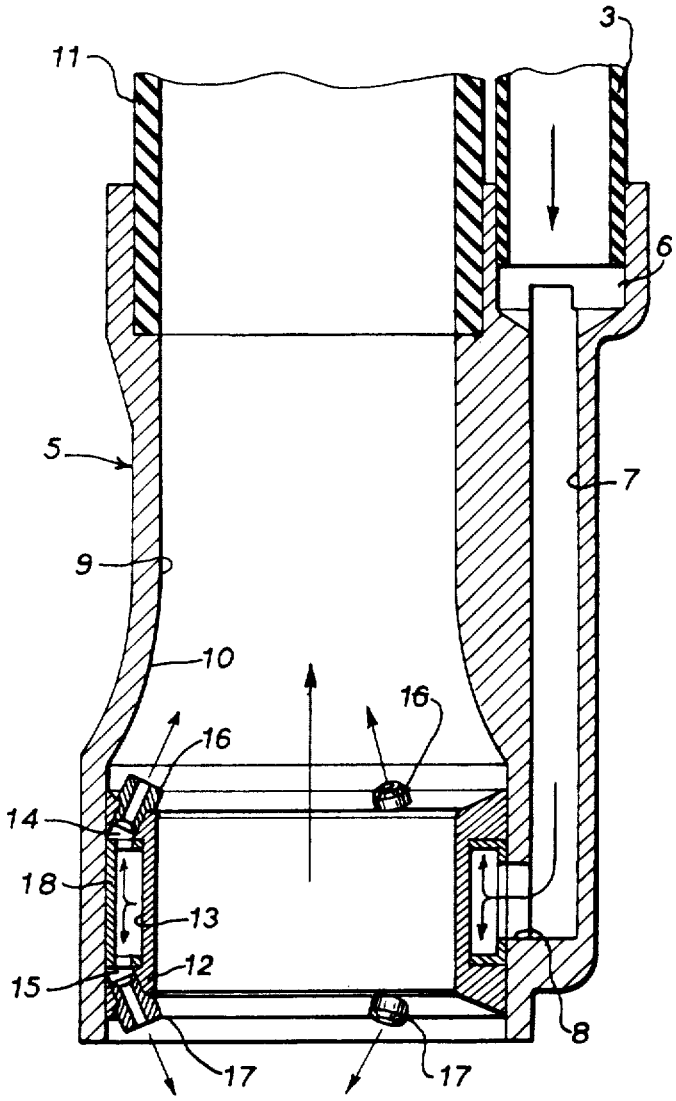
FIG. 2 is a fragmentary longitudinal section of the distal end of the device.

The outer or distal end of tube 3 is connected to a metal housing 5, as shown in FIG. 2. Housing 5 is provided with a recess 6 which is offset from the axis of the housing and the distal end of the tube 3 is secured within recess 6. Recess 6 communicates with the upper end of a longitudinal passage 7 in housing 5 and the opposite end of passage 7 is connected to a port 8 which extends radially of housing 5.

Housing 5 is provided with a central opening 9 and a portion 10 of the housing which is located centrally of the length of the housing is tapered inwardly to provide a venturi. The upper end of housing 5 is provided with an axial recess and the lower end of a flexible conduit 11 is secured within the recess. Conduit 11 can have any desired length and serves to conduct the removed soil or other material to a desired location. As the conduit 11 is flexible, the discharge of the material can be made to any desired location.

Mounted within the lower or distal end of housing 5 is an annular member 12 which is provided with a peripheral recess that defines an annular chamber 13. Port 8 communicates with chamber 13 so that the air being supplied through the air tube 3 is discharged into chamber 13.

The upper end of annular member 12 is provided with a plurality of holes 14, and similarly the lower end of member 12 is formed with a plurality of holes 15 and nozzles 16 and 17 are mounted in the holes 14 and 15 respectively. The axes of the lower nozzles 17 converge at a point located outside of housing 5 and generally along the axis of the housing, while the axes of the upper nozzles 16 converge at a point which is located within the housing 5 and co-extensive with the housing axis. While the drawings illustrate three downwardly facing nozzles 17 and three upwardly facing nozzles 16, it is contemplated that any number of nozzles can be employed.

The air in chamber 13 being discharged through the lower nozzles 17 serves an excavating function to dislodge the soil or other material while the air being discharged through the upper nozzles 16 into the venturi 10 creates an aspirating action to draw the dislodged soil or other material upwardly through the housing 5 and the removal conduit 11.

To control the flow through the nozzles 16 and 17 an annular valve 18 is mounted for rotation within chamber 13. Valve 18 is preferably formed of a thermoplastic material which is relatively flexible so that it will tend to seal against the member 12. As best seen in FIG. 4, valve 18 includes an annular web portion 19 and a pair of flanges 20 and 21 extend radially from the opposite ends of web portion 19. In addition, web portion 19 is formed with a slot 22 which is elongated in a circumferential direction and registers with inlet port 8. Due to the elongated slot 22, port 8 will be in communication with chamber 13 as the valve 18 is rotated relative to annular member 12.

To rotate valve 18, a pin 23 extends through an elongated slot 24 in housing 5 and the inner end of the pin projects through a hole in the web portion 19 of valve 18 and is connected an arcuate metal backing plate 25. As valve 18 is formed of a flexible plastic material, the backing plate 25 provides a firm connection between the pin 23 and the valve. By moving the pin 23 circumferentially within the slot 24, valve 18 can be rotated.

Upper flange 20 of valve 18 is provided with three pairs of holes or valve ports 26 and 27, with each pair of holes corresponding to one of the upper nozzles 16. Similarly, the lower flange 21 of valve 18 is formed with three pairs of holes or valve ports 28 and 29 and each pair of holes 28 and 29 corresponds to one of the lower nozzles 17.

The valving arrangement for distributing the air to the nozzle 16 and 17 is best illustrated in FIG. 5. When the valve 18 is in the full line position shown in FIG. 5, one of the lower holes 26 will register with the corresponding nozzle 17 and hole 29 of an upper pair will register with the corresponding upper nozzle 16. Thus the air introduced into chamber 13 will flow through hole 26 and nozzle 17 and be directed downwardly into the soil for an excavating function and similarly the air will flow through hole 29 and upper nozzle 16 to provide an aspirating action to remove the dislodged soil. Thus, with the arrangement shown in FIG. 5, both an excavating and removal mode occurs.

By rotating valve 18 through operation of pin 23 in the direction of the full arrow, as shown in FIG. 5, hole 27 will be brought into registry with the lower nozzle 17, while the upper holes 28 and 29 will be out of registry with the respective upper nozzle 16. Thus, in this mode of operation, the air in chamber 13 will only be directed through holes 27 and nozzles 17 downwardly to provide an excavating function.

If the valve 18 is rotated from the position shown in FIG. 5 in the direction of the dashed arrow, hole 28 will register with the upper nozzle 16 to direct air upwardly into the housing for a removal function, and both of the holes 26 and 27 will be out of registry with the lower nozzle 17 so that no air is directed downwardly.

The slot 24 is designed so that when the pin 23 engages one end of the slot, hole 27 will be in registry with the lower nozzle 17 and when the pin engages the opposite end of the slot, hole 28 will be in registry with the upper nozzle 16.

With this construction, the operator by rotating pin 23 in slot 24 can selectively change between an excavating mode and a removal mode as well as a combination of the two. Further, air being supplied either for excavating or removal can be varied or throttled to obtain any desired degree of excavating and removal.

As a further advantage, the nozzles 16 and 17 are located along the periphery of the housing 5 so that the annular member 12 has an unobstructed central opening of substantial size, thus minimizing clogging of the device.

Various modes of carrying out the invention are contemplated as being within the scope of the following claims particularly pointing out and distinctly claiming the subject matter which is regarded as the invention.

I claim:

1. A high velocity pneumatic device for excavating and removing material, comprising a pressure tube having an inlet connected to a source of gas under pressure and an outlet end, a removal conduit having a first end to receive dislodged material and having a second end through which the material is discharged, annular nozzle means connected to an inner surface of the first end of said removal conduit and spaced radially outward of the axis of said removal conduit, said nozzle means including a first nozzle member spaced from the axis of the removal conduit and disposed adjacent the inner surface of said removal conduit, said first nozzle member facing outwardly of said first end, and said nozzle means also including a second nozzle member spaced from the axis of the removal conduit and disposed adjacent the inner surface of said removal conduit, said second nozzle member facing said second end, and gas supply means interconnecting the outlet end of the pressure tube and said nozzle means for supplying a gas under pressure to said nozzle means.

2. The device of claim 1, and including valve means for selectively directing gas from said gas supply means to said first and second nozzle members, 3. The device of claim 1, wherein said nozzle means has a central unobstructed opening.

4. The device of claim 1, and including a plurality of said first nozzle members with the axes of said first nozzle members intersecting at a point located outwardly of the first end of said removal conduit.

5. The device of claim 1, and including a plurality of second nozzle members with the axes of said second nozzle members intersecting at a point disposed within said removal conduit.

6. The device of claim 2, wherein said valve means comprises a valve member disposed for movement relative to said nozzle means and movable between a first position where said valve member establishes communication between said gas supply means and said first nozzle member to direct gas outwardly of said removal conduit to provide an excavating function, and a second position where said valve member establishes communication between said gas supply means and said second nozzle member to direct gas toward said second end to provide an aspirating action and remove dislodged material, and a third position where said valve member establishes communication between said gas supply means and both said first and second nozzle members.

7. The device of claim 6, and including means for moving said valve member between said first, second and third positions.

8. A high velocity pneumatic device for excavating and removing material, comprising a pressure tube having an inlet connected to a source of gas under pressure and having an outlet end, a removal conduit having a first end to receive dislodged material and having a second end through which said dislodged material is discharged, nozzle means connected to the inner surface of said removal conduit adjacent said first end and defining an annular chamber, said outlet end of the pressure tube being connected to said annular chamber, said nozzle means also including a plurality of first nozzle members facing outwardly of said first end of said removal conduit and a plurality of second nozzle members facing said second end of the removal conduit, said first and second nozzle members being in communication with said annular chamber, and valve means mounted for rotation within said chamber for selectively directing air from said chamber to said first and second nozzle members.

9. The device of claim 8, and including manual means operably connected to said valve means for rotating said valve means circumferentially in said chamber.

10. The device of claim 8, wherein said valve means is movable between a first position wherein said first nozzle members are in communication with said chamber and to direct air through said first nozzle members and provide an excavating action and a second position where said second nozzle members are in communication with said chamber to provide an aspirating action to remove dislodged material and a third position where both said first and second nozzle members are in communication with said chamber.

11. The device of claim 8, wherein said valve means comprises an annular valve member disposed in said chamber and including a plurality lower valve ports disposed to register between said chamber and said first nozzle members and a plurality of upper valve ports disposed to provide registry between said second nozzle members and said chamber.

12. The device of claim 11, wherein said device includes a pair of lower valve ports for each first nozzle member and a pair of upper valve ports for each second nozzle member, said valve member moveable between a first position where one of each pair of lower valve ports provides communication between the corresponding first nozzle member and said chamber and each pair of upper valve ports are out of registry with the corresponding second nozzle members, and a second position where one of each pair of upper valve ports is in registry with the corresponding second nozzle member and each pair of said lower valve ports are out of registry with the corresponding first nozzle members and a third position wherein one of each pair of said lower valve ports is in registry with a corresponding first nozzle member and one of each pair of upper valve ports is in registry with a corresponding second nozzle member.

13. The device of claim 11, wherein said valve member includes a web and a pair of parallel radially extending flanges, said lower valve ports being in one flange and said upper valve ports being in the other flange.

14. The device of claim 11, wherein the axes of the first nozzle members intersect at a point located outwardly of said removal conduit.

15. The device of claim 11, wherein the axes of said second nozzle members intersect at a point located within said removal conduit and disposed generally on the axis of said removal conduit.

16. An improved high velocity pneumatic device for excavating and removing material, comprising a pressure tube having an inlet end to be connected to a source of air under pressure and having an outlet end, a removal conduit having a first end to receive dislodged material and having a second end to discharge said dislodged material, annular nozzle means connected to the inner surface of said removal conduit adjacent said first end and defining an annular air chamber, port means providing communication between the outlet end of said pressure tube and said air chamber, said nozzle means including a plurality of lower nozzles communicating with said air chamber with the axes of said lower nozzles intersecting at a point located outwardly of the first end of said removal conduit, said nozzle means also including a plurality of upper nozzles communicating with said chamber with the axes of said upper nozzles intersecting at a point located within said removal conduit, annular valve means disposed in said chamber for selectively directing air from said chamber to said first and second nozzles, and means connected to said valve means and extending to the exterior of said device for rotating said valve means in said chamber.

17. The device of claim 16, wherein said nozzle means has a central unobstructed opening.

* * * * *